US005782343A

United States Patent [19]

Harrelson

[11] Patent Number: 5,782,343

[45] Date of Patent: Jul. 21, 1998

[54] WARP-AROUND CARRIER WITH IMPROVED LOCKING MEANS

[75] Inventor: Glen R. Harrelson, Gainsville, Ga.

[73] Assignee: Riverwood International Corporation, Atlanta, Ga.

[21] Appl. No.: 788,305

[22] Filed: Jan. 24, 1997

[51] Int. Cl.[6] ..... B65D 5/42

[52] U.S. Cl. ..... 206/140; 229/198.2

[58] Field of Search ..... 206/140, 427, 206/434; 229/198.2, 103.2

[56] References Cited

U.S. PATENT DOCUMENTS

| | | | |
|---|---|---|---|
| 3,652,005 | 3/1972 | Morgese | 206/434 |
| 4,708,284 | 11/1987 | Sutherland | 206/434 |
| 5,004,147 | 4/1991 | Bienaime | 206/140 |
| 5,443,203 | 8/1995 | Sutherland | 229/198.2 |
| 5,542,536 | 8/1996 | Sutherland | 206/140 |
| 5,682,995 | 11/1997 | Sutherland | 206/140 |

*Primary Examiner*—David T. Fidei

[57] ABSTRACT

A wrap-around carrier having primary and secondary locks for connecting the bottom panel flaps together. One of the bottom panel flaps includes a foldably connected male locking flap having a primary locking tab adjacent the fold and a secondary locking flap at the other end. The other bottom panel flap contains primary and secondary female locking openings. The bottom panel flap containing the male locking flap partially overlaps the other bottom panel flap, with the male locking tabs being inserted into the female locking openings.

10 Claims, 3 Drawing Sheets

WARP-AROUND CARRIER WITH IMPROVED LOCKING MEANS

FIELD OF THE INVENTION

This invention relates to a mechanical lock for securing two flaps together to form a panel of a carton. More particularly, it relates to a mechanical lock adapted for use in a wrap-around carrier.

BACKGROUND OF THE INVENTION

Wrap-around carriers or cartons are commonly used to package beverage containers as well as other types of articles. To form a package the centrally located top panel section of a carrier blank is normally positioned on a group of articles to be packaged and the side panel sections are folded down. Bottom panel flaps at opposite ends of the blank are then folded into place, with one of the flaps partially overlapping the other. Although the bottom panel flaps in some carriers are glued to each other, integral mechanical locks are commonly employed to connect the flaps together. Typically, primary locking tabs on one of the flaps engage an edge of a primary locking opening in the other flap, and separately formed secondary locking tabs are secured in secondary locking openings to prevent the primary locks from separating.

A variety of locking mechanism designs have been used over the years. While many of the designs are capable of adequately locking bottom panel flaps together, it would nevertheless be desirable to provide an improved locking mechanism which not only locks the bottom panel flaps in place and prevents them from separating, but also reduces the cost of the carton by reducing the material usage of the carrier. In addition, the locking mechanism should be such that the bottom panels can be locked together by existing packaging machinery.

It is an object of the invention to provide a panel locking mechanism which meets these criteria.

BRIEF SUMMARY OF THE INVENTION

The invention is incorporated in a carton which includes a panel formed from a pair of partially overlapped mechanically connected flaps. The overlapping panel flap includes a male locking flap which is foldably connected to the panel flap. A primary locking tab is at one end of the male locking flap adjacent the locking flap fold line and a secondary locking tab is at the other end. The primary locking tab extends into a primary locking opening in the overlapped panel and a secondary locking tab extends into a secondary locking opening in the overlapped panel to lock the panels together.

In a preferred arrangement the male locking flap fold line is comprised of spaced segments, with the primary locking tab being located between the spaced segments. The male locking flap extends from the male locking flap fold line over the free edge of the first panel flap and into the secondary locking opening. The primary female locking opening is thus in the overlapped area of the panels and includes an edge substantially parallel to the male locking flap fold line, with the secondary female locking opening being spaced therefrom. Typically, the pair of flaps are the bottom panel flaps of a wrap-around carrier.

In addition to providing a strong secure lock to hold the bottom panel flaps together, the carrier is economical to produce, aided by the fact that the male locking flap is formed from an opening in the overlapping bottom panel flap and thus reduces the amount of carrier material in a blank. These and other aspects and benefits of the invention will readily be apparent from the more detailed description of the preferred embodiment of the invention which follows.

DETAILED DESCRIPTION OF THE PREFERRED EMBODIMENT

Figure 1:
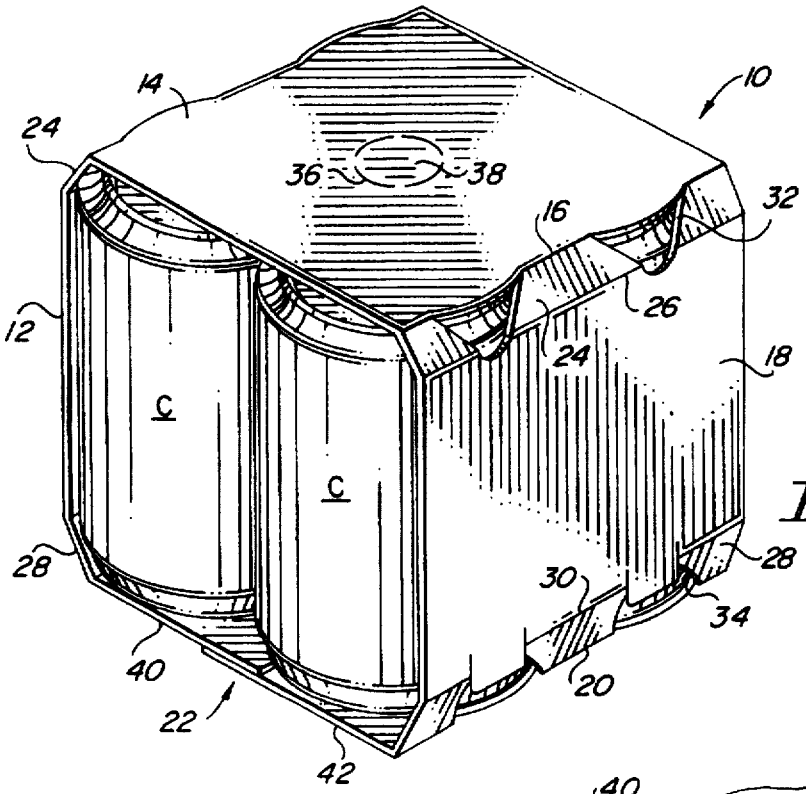
FIG. 1 is a pictorial view of a wrap-around carrier incorporating the locking mechanism of the invention.

Referring to FIG. 1, the invention is incorporated in package 10, which is comprised of wrap-around carrier 12 containing four beverage cans C. The carrier is of basic wrap-around design, including a top panel 14 connected by fold lines 16 to side panels 18, which in turn are connected by fold lines 20 to bottom panel 22. Included in the side panels are sloped shoulder panel sections 24, defined by fold lines 16 and 26, and sloped heel panel sections 28, defined by fold lines 20 and 30. Can lid cutouts 32 are provided in the shoulder panel sections 24 and heel cutouts 34 are provided in the heel panel sections 28. A finger hole 36 covered by separable tab 38 is provided in the top panel for use as a grip for lifting the carrier. As described in more detail below, the bottom panel is formed from partially overlapping flaps 40 and 42 which are connected to each other by the mechanical locking means of the invention.

Figure 2:
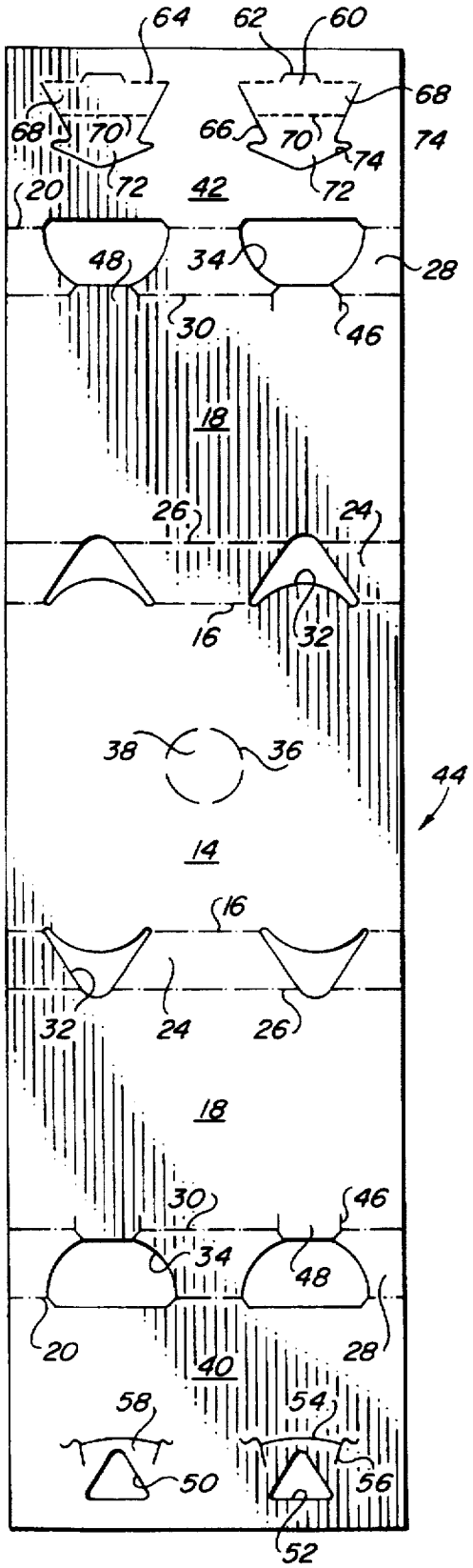
FIG. 2 is a plan view of a blank for forming the carrier of FIG. 1.

A blank 44 for forming the carrier is shown in FIG. 2 as comprising a generally rectangular sheet of flexible material possessing sufficient stiffness and strength to make it capable of withstanding the stresses to which the carrier is subjected during packaging and use. Paperboard of the type normally associated with the carrier industry is preferred. The top panel section 14 is substantially centrally located in the sheet between the shoulder panel portions 24 of side panel sections 18, and the bottom panel flaps 40 and 42 are connected to the heel panel portions 28 of the side panel sections. The heel cutouts extend throughout the major portion of the width of the associated heel panel section 28 and for a slight distance into the bottom panel flaps 40 and 42. Spaced slits 46 in the side panel sections 18 extend to the inner edge of the heel cutouts 34 to form tabs 48 which are arranged so as to contact the sides of packaged cans just above the heel cutouts.

Spaced from the outer end of the bottom panel flap 40 are two primary locking openings 50 which include an outer edge 52 parallel to the fold line 20. Inwardly spaced from each primary locking opening 50 is a secondary locking opening in the form of arcuate slit 54 and contiguous end slits 56 which together form tabs 58. The primary and secondary locking openings are located opposite the heel cutout areas.

Spaced from the outer edge of the bottom panel flap 42 are two primary locking tabs 60 formed by slits 62. Extending from the ends of each tab 60 are fold lines 64. Connecting the ends of the fold lines 64 are slits 66 which together with the fold lines 64 and tabs 60 form male locking flaps 68. Transverse fold lines 70 extending across the width of the locking flaps 68 separate the flaps into a portion containing the primary locking tab 60 and a portion consisting of secondary locking tab 72. Both the fold lines 70 and 64 are parallel to the fold line 20. The secondary locking tab 72 is generally in the shape of an arrow head, including ears 74.

Figure 4:
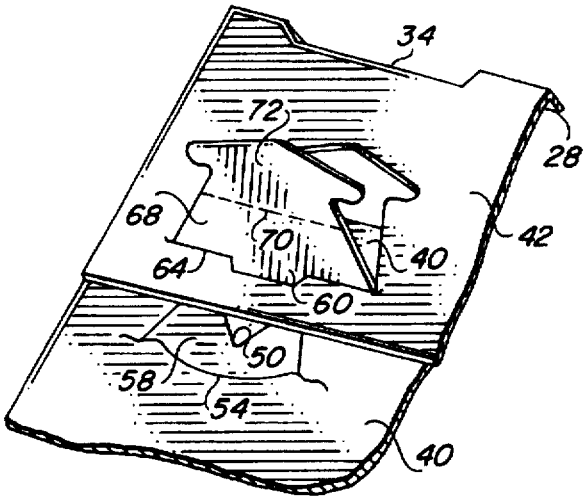
FIG. 4 is a partial pictorial view of the bottom panel flaps of the carrier at an initial stage of formation of one of the bottom panel locks.
Figure 3:
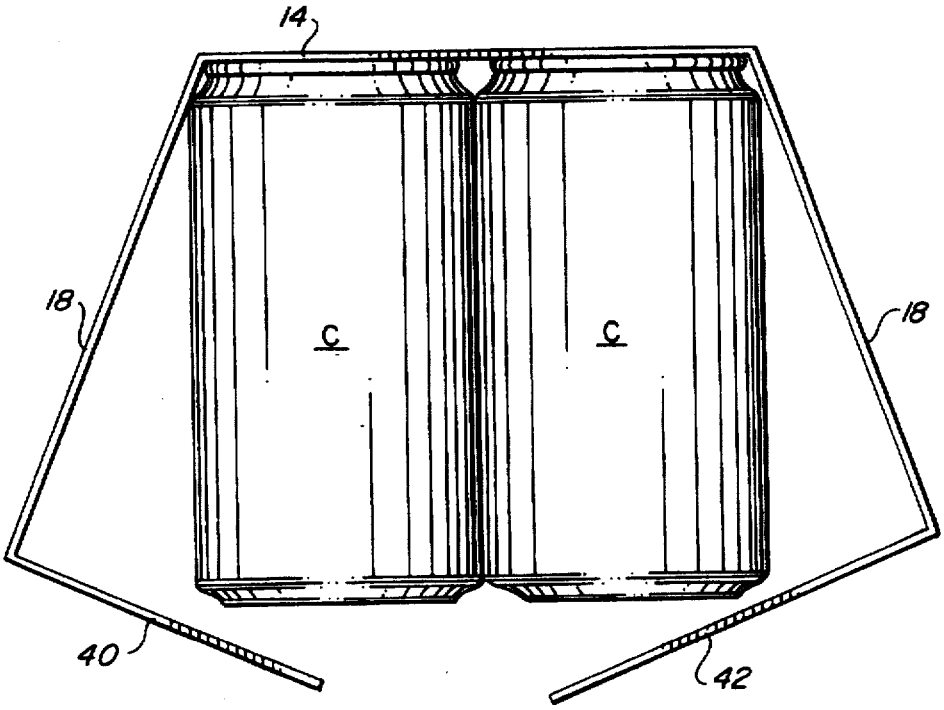
FIG. 3 is an end view of an initial stage of the formation of a carrier from the blank of FIG. 2.
Figure 5:
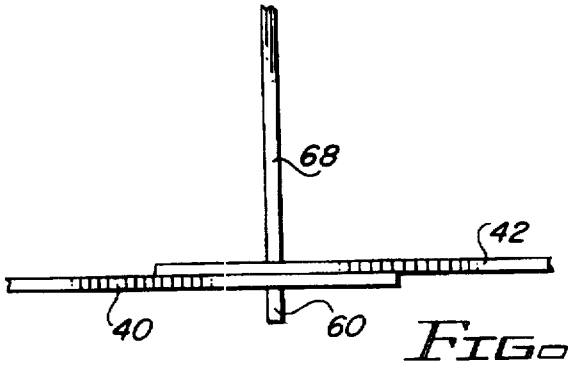
FIG. 5 is partial end view of the interim form of carrier lock shown in FIG. 4.

To form a package, the articles are segregated into the desired final arrangement and the blank is positioned so that the top panel section rests on top of the cans. The side panel sections and the bottom panel flaps are then folded in the conventional manner. A typical point in this folding process is illustrated in FIG. 3. As the inward folding of the bottom panel flaps continues the male locking flaps 68 are folded outwardly, eventually pivoting about the fold lines 64 through an angle of substantially 180°. As the folding process of the male locking flaps and the bottom panels continues a point is reached at which the bottom panel flaps have reached their final relative positions in which the bottom panel flap 42 partially overlaps the bottom panel flap 40 and the male locking flaps 68 have been folded out from the bottom panel flap 42 through an angle of approximately 90°. At this point the primary male locking tabs 60 are directly aligned with the edges 52 of the primary female locking openings 50 and extend through the locking opening 50. The relative positions of the locking elements at this point in the package forming process are illustrated in FIGS. 4 and 5.

Figure 7:
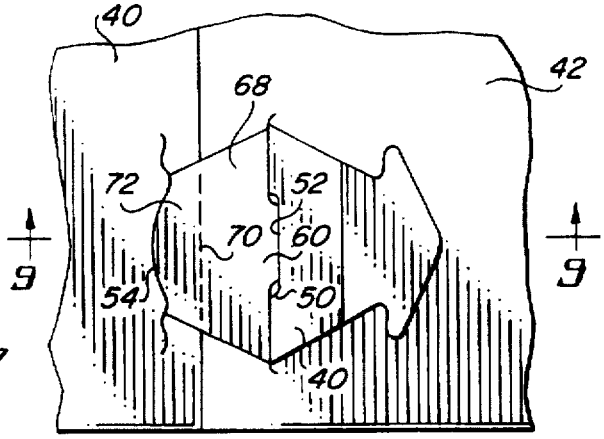
FIG. 7 is a partial plan view of the bottom panel of the finished carrier, showing the locking tabs in their final positions.
Figure 8:
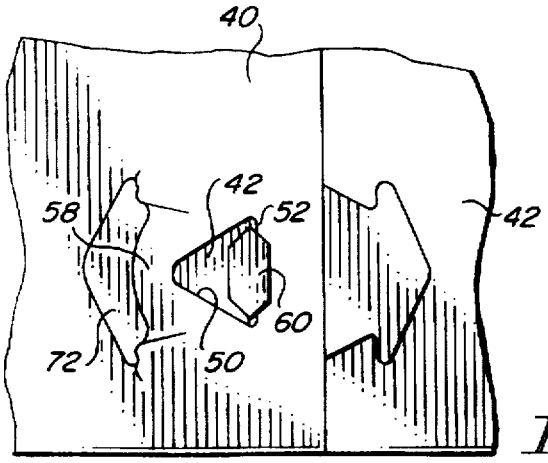
FIG. 8 is a partial plan view of the interior of the bottom panel of the finished carrier, with the packaged articles omitted.
Figure 6:
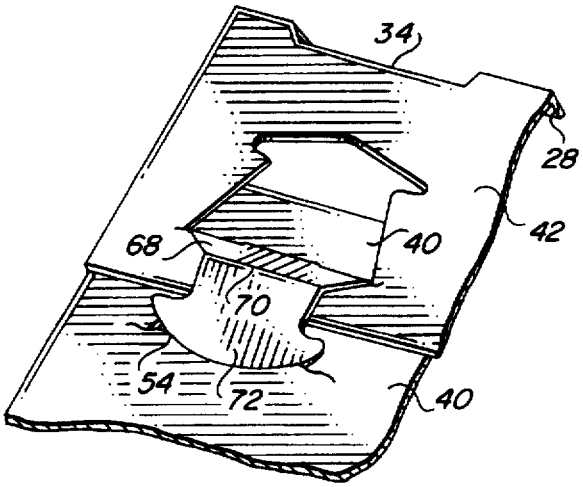
FIG. 6 is a partial pictorial view of the bottom panel flap similar to that of FIG. 4, but showing the locking tabs at a later stage of lock formation.
Figure 9:
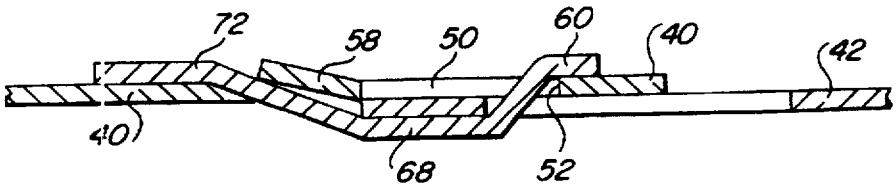
FIG. 9 is an enlarged transverse sectional view taken on line 9—9 of FIG. 7.

As the male locking flaps 68 continue to be pivoted about the fold lines 64 the secondary locking tab portions 72 are folded about the fold lines 70 to bring the ends of the secondary locking tabs to the slits 54 of the secondary locking openings. This intermediate point in the locking process is illustrated in FIG. 6. Pressure on the fold line 70 of the secondary locking tabs moves the secondary locking tabs into the interior of the carrier beneath the slit 54, pushing the secondary locking opening tabs 58 out of the plane of the bottom panel flap 40. The tabs 58 are biased against movement out of the plane of bottom panel flap 40, thus being urged against the secondary locking tabs 72 to help maintain them in place. The primary and secondary locks at this point are now fully activated. The final arrangement of the locks as they appear from the exterior of the carton is shown in FIG. 7. The final arrangement of the locks as they appear from the interior of the carton is shown in FIG. 8. The relationship of the locking elements in their final locked condition is illustrated in FIG. 9. Note that the primary and secondary locking tabs are firmly locked in place. The secondary locking tabs 72 are being urged by the tabs 58 against the interior face of the bottom panel flap 40, while the locked condition of the secondary locking tabs 72 causes the primary locking tabs 60 to also be held against the inner face of the bottom panel flap 40. In addition, the locking flaps 68 are looped over the ends of the bottom panel flap 42, forming a strap-like configuration which further supports and strengthens the bottom panel.

Although the various folding steps and the tightening step can be performed by hand, it is preferred to carry them out by conventional elements of a packaging machine, which are well known in the industry and need no further explanation or illustration. Although the panel locking process has been described in connection with the formation of an upright carton, it will be understood that the same principles would apply if the panel were formed with the carton inverted. Also, although described in connection with the packaging of beverage cans, the principles of the invention may be applied to carriers designed to package other types of articles.

It will be appreciated that the locking system of the invention provides the carrier with the structural integrity to support packaged articles without risk of failure of the locked panel flaps. Since the male locking flaps are fully formed from the overlapping bottom panel flap the length of the blank is reduced, thus reducing the cost of the carrier material.

It should be understood that the invention is not limited to all the specific details described in connection with the preferred embodiment and that changes to certain features of the preferred embodiment which do not alter the overall basic function and concept of the invention may be made without departing from the spirit and scope of the invention defined in the appended claims.

What is claimed is:

1. A wrap-around article carrier, comprising: opposite side panels connected to a top panel and a bottom panel;

the bottom panel being comprised of first and second bottom panel flaps, each bottom panel flap having a free edge;

the first bottom panel flap partially overlapping the second bottom panel flap to form an overlapped area and containing a male locking flap, integrally formed from the first bottom panel, having a base end and an opposite end, the base end being connected by a fold line to a portion of the first bottom panel flap and spaced inwardly from the free edge thereof;

the second bottom panel flap containing primary and secondary female locking openings, the primary female locking opening being in the overlapped area of the second bottom panel flap and the secondary female locking opening being spaced from the overlapping area; and the male locking flap including a primary locking tab adjacent the base end of the locking flap and a secondary locking tab at the opposite end thereof;

the primary locking tab extending into the primary locking opening in locking engagement therewith and the secondary locking tab extending into the secondary locking opening in locking engagement therewith, said male locking flap extending from the male locking flap fold line over the free edge of the first bottom panel flap and into the secondary female locking opening thereby providing a strap-like configuration to support and strengthen the bottom panel of said wrap around carrier.

2. A wrap-around article carrier as defined in claim 1, wherein the male locking flap fold line is comprised of spaced segments, the primary locking tab being located between the spaced segments.

3. A wrap-around article carrier as defined in claim 1, wherein the primary female locking opening is in the overlapped area of the panels and includes an edge substantially parallel to the male locking flap fold line, the secondary female locking opening being spaced therefrom.

4. A wrap-around article carrier as defined in claim 3, wherein the secondary female locking opening is comprised of a slit.

5. A wrap-around article carrier as defined in claim 4, wherein the slit at least partially defines a biasing tab located between the primary female locking opening and the slit, the biasing tab engaging the secondary male locking tab.

6. A blank for forming a wrap-around carrier, comprising:

a centrally located top panel section;

a side panel section connected by a fold line to opposite edges of the top panel section;

a first bottom panel flap connected by a fold line to one of the side panel sections and second bottom panel flap connected by a fold line to the other side panel section;

the first and second bottom panel flaps having outwardly extending free edges;

a male locking flap integrally formed from said first bottom panel flap and having a base end and an opposite end, the base end being connected by a fold line to the first bottom panel flap;

the second bottom panel flap containing primary and secondary female locking openings, the primary female locking opening being between the free edge of the second bottom panel flap and the secondary female locking opening;

the male locking flap including a primary locking tab adjacent the base end of the locking flap and a secondary locking tab at the opposite end thereof;

the primary locking tab extending into the primary locking opening and the secondary locking tab extending into the secondary locking opening in a carrier formed from the blank, said secondary female locking opening being dimensioned to be spaced from the overlapping area of said first and second bottom panel flaps in a carrier formed from said blank.

7. A carrier blank as defined in claim 6, wherein the male locking flap fold line is comprised of spaced segments, the primary locking tab being located between the spaced segments.

8. A carrier blank as defined in claim 6, wherein the primary female locking opening is between the free edge of the second bottom panel flap and the secondary female locking opening, the primary female locking opening including an edge substantially parallel to the male locking flap fold line.

9. A carrier blank as defined in claim 8, wherein the secondary female locking opening is comprised of a slit.

10. A carrier blank as defined in claim 9, wherein the slit at least partially defines a biasing tab located between the primary female locking opening and the slit, the biasing tab engaging the secondary male locking tab in a carrier formed from the blank.

* * * * *